US007225753B1

(12) United States Patent
Lo

(10) Patent No.: US 7,225,753 B1
(45) Date of Patent: Jun. 5, 2007

(54) BELL DEVICE

(76) Inventor: Yi Hsuan Lo, 2F, No. 15, Lane 43, Wuchang Street, North Dist., Taichung 40458 (TW)

( * ) Notice: Subject to any disclaimer, the term of this patent is extended or adjusted under 35 U.S.C. 154(b) by 0 days.

(21) Appl. No.: 11/388,958

(22) Filed: Dec. 28, 2005

(51) Int. Cl.
*G10K 1/10* (2006.01)
*G10K 1/06* (2006.01)

(52) U.S. Cl. ..... 116/167; 116/148; 116/155; 84/406; 446/422

(58) Field of Classification Search ..... 116/167, 116/148, 150, 152, 155, 170, 171, 25; 84/103, 84/406, 410; 446/397, 418, 421, 422
See application file for complete search history.

(56) References Cited

U.S. PATENT DOCUMENTS

| | | | | | |
|---|---|---|---|---|---|
| 239,013 | A * | 3/1881 | Connell | 116/155 |
| 247,610 | A * | 9/1881 | Butler | 116/155 |
| 482,983 | A | 9/1892 | Piper | 116/160 |
| 704,289 | A * | 7/1902 | Augir | 116/148 |
| 718,241 | A * | 1/1903 | Bauknecht | 116/150 |
| 870,025 | A * | 11/1907 | Elsas | 84/406 |
| 1,349,694 | A * | 8/1920 | Alexander | 116/80 |
| 1,528,463 | A * | 3/1925 | Yungk | 116/148 |
| 2,739,570 | A * | 3/1956 | Frantz | 91/234 |
| 2,787,929 | A * | 4/1957 | Musser | 84/406 |
| 4,792,795 | A * | 12/1988 | Foran | 340/393.4 |
| 6,346,664 | B1 * | 2/2002 | Shuen | 84/402 |
| 6,722,308 | B1 * | 4/2004 | Moulden | 116/171 |
| 6,739,282 | B1 | 5/2004 | Yuan | 116/167 |
| 6,871,613 | B2 * | 3/2005 | Murray et al. | 116/148 |

* cited by examiner

*Primary Examiner*—Diego Gutierrez
*Assistant Examiner*—Amy R. Cohen
(74) *Attorney, Agent, or Firm*—Charles E. Baxley

(57) ABSTRACT

A bell device includes a housing having two housing members secured together, and one or more peripherals rib extended into an opening of the housing, a securing device includes a shank engaged in the opening of the housing, and includes a peripheral flange extended from the shank for engaging with the peripheral rib of the housing and for anchoring the shank to the housing when the two housing members are assembled together, a bell member is supported in the housing with the securing device, a clapper includes a stem pivotally attached to the securing device and a striking member for striking onto the bell member. A push rod may actuate the clapper to strike onto the bell member.

6 Claims, 4 Drawing Sheets

BELL DEVICE

BACKGROUND OF THE INVENTION

1. Field of the Invention

The present invention relates to a bell device, and more particularly to a bell device having a solid assembling or securing structure for solidly attaching or coupling the clapper into the bell device.

2. Description of the Prior Art

Typical bell devices comprise a metallic outer shell, a pivotal or movable clapper disposed in the metallic outer shell, and an actuator or push rod slidably disposed in the upper portion of the metallic outer shell for being depressed or actuated to act onto the clapper and for forcing the clapper to strike onto or against the metallic outer shell.

For example, U.S. Pat. No. 482,983 to Piper discloses one of the typical bell devices comprising a disk-shaped striker rotatably disposed in the inner portion of the metallic outer shell, and an actuator or push rod slidably disposed in the metallic outer shell for acting onto the clapper and for forcing the striker to strike onto or against the metallic outer shell.

For the typical bell devices, the metallic outer shell is exposed and may be easily contacted by people or by various objects, such that the bell device may not be used to generate sound when stricken by the striker and when the metallic outer shell is contacted by people or by various objects.

U.S. Pat. No. 6,739,282 to Yuan discloses another typical bell device comprising a metallic bell body suspended or supported in an outer housing with a securing device, and a clapper pivotally disposed in the inner portion of the metallic bell body, and an actuator or push rod slidably attached to the outer housing and extendible into the metallic bell body for acting onto the clapper and for forcing the clapper to strike onto or against the metallic bell body.

The securing device includes a conduit having a peripheral catch for engaging through an upper barrel from a lower portion of the outer housing and for coupling or attaching the clapper to the metallic bell body. In operation, the actuator or push rod will be depressed or pushed downwardly relative to the outer housing and the metallic bell body for acting onto the clapper.

However, when the actuator or push rod is depressed or pushed downwardly relative to the outer housing and the metallic bell body, the conduit of the securing device will also be slightly depressed or pushed downwardly relative to the outer housing and the metallic bell body, such that the peripheral catch of the conduit may have a good chance to be disengaged from the outer housing and the metallic bell body after use.

The present invention has arisen to mitigate and/or obviate the afore-described disadvantages of the conventional bell devices.

SUMMARY OF THE INVENTION

The primary objective of the present invention is to provide a bell device including a solid assembling or securing structure for solidly attaching or coupling the clapper into the bell device.

In accordance with one aspect of the invention, there is provided a bell device comprising a housing including two housing members secured together, and including an opening formed therein, and including at least one peripheral rib extended into the opening of the housing, the housing members each including one half of the peripheral rib and one half of the opening for forming the peripheral rib and the opening in the housing after the two housing members are assembled together, a securing device including a shank engaged in the opening of the housing, and including a peripheral flange extended from an upper portion of the shank for engaging with the peripheral rib of the housing and for anchoring the shank to the housing when assembling the two housing members together, the securing device including a bore formed therein, and including a peripheral flap extended from a lower portion of the shank, a bell member disposed in the housing and including an upper orifice formed therein for receiving the shank of the securing device, and the peripheral flap of the securing device being engaged with the bell member for supported the bell member in the housing with the securing device, a clapper including a stem having an upper shaft pivotally attached to the peripheral flap of the securing device for pivotally attaching the clapper to the securing device, and including a lower striking member for striking onto the bell member, a biasing device for biasing the striking member of the clapper away from the bell member, and a push rod slidably engaged in the bore of the shank and including a lower end for contacting and engaging with the upper portion of the shank, and for forcing the clapper to rotate relative to the bell member, and a knob attached to the push rod for moving the push rod to actuate and to rotate the clapper relative to the bell member, and for actuating the striking member of the clapper to strike onto the bell member, and the push rod is depressible to engage with and to rotate the clapper relative to the bell member and to actuate the striking member of the clapper to strike onto the bell member and to generate sounds, and the biasing device may bias and force the striking member of the clapper away from the bell member after the push rod is released.

A first housing member of the housing members includes a plurality of cavities formed therein, and a second housing member of the housing members includes a plurality of pegs extended therefrom and engaged into the cavities of the first housing member for securing the housing members together.

The housing includes at least one orifice formed therein for sound resonant purposes. A clamping ring is attached onto the push rod for engaging with the shank and for limiting the push rod to move relative to the shank.

The shank includes an enlarged compartment formed in the lower portion of the shank, and the compartment of the shank includes an inner diameter greater than that of the bore of the shank for forming an inner peripheral shoulder in the shank and for engaging with the clamping ring.

The securing device includes a non-circular bulge extended radially and outwardly from the shank, and the orifice of the bell member is non-circular for receiving the non-circular bulge of the securing device and for anchoring the bell member to the securing device and for preventing the bell member from rotating relative to the securing device.

The securing device includes two ears extended from the peripheral flap, and the ears each includes an aperture formed therein for rotatably receiving the shaft of the stem of the clapper.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
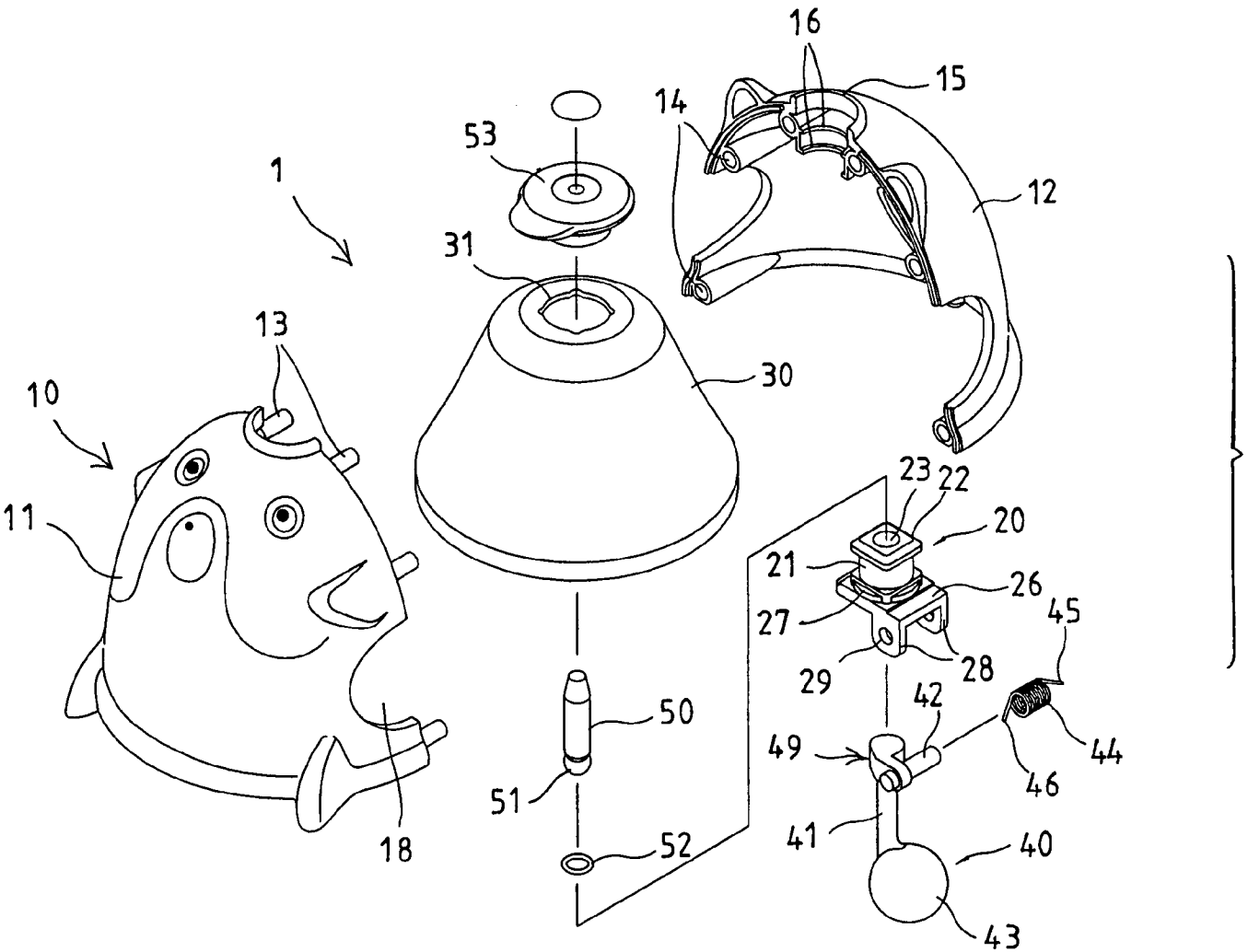
FIG. 1 is an exploded view of a bell device in accordance with the present invention.
Figure 2:
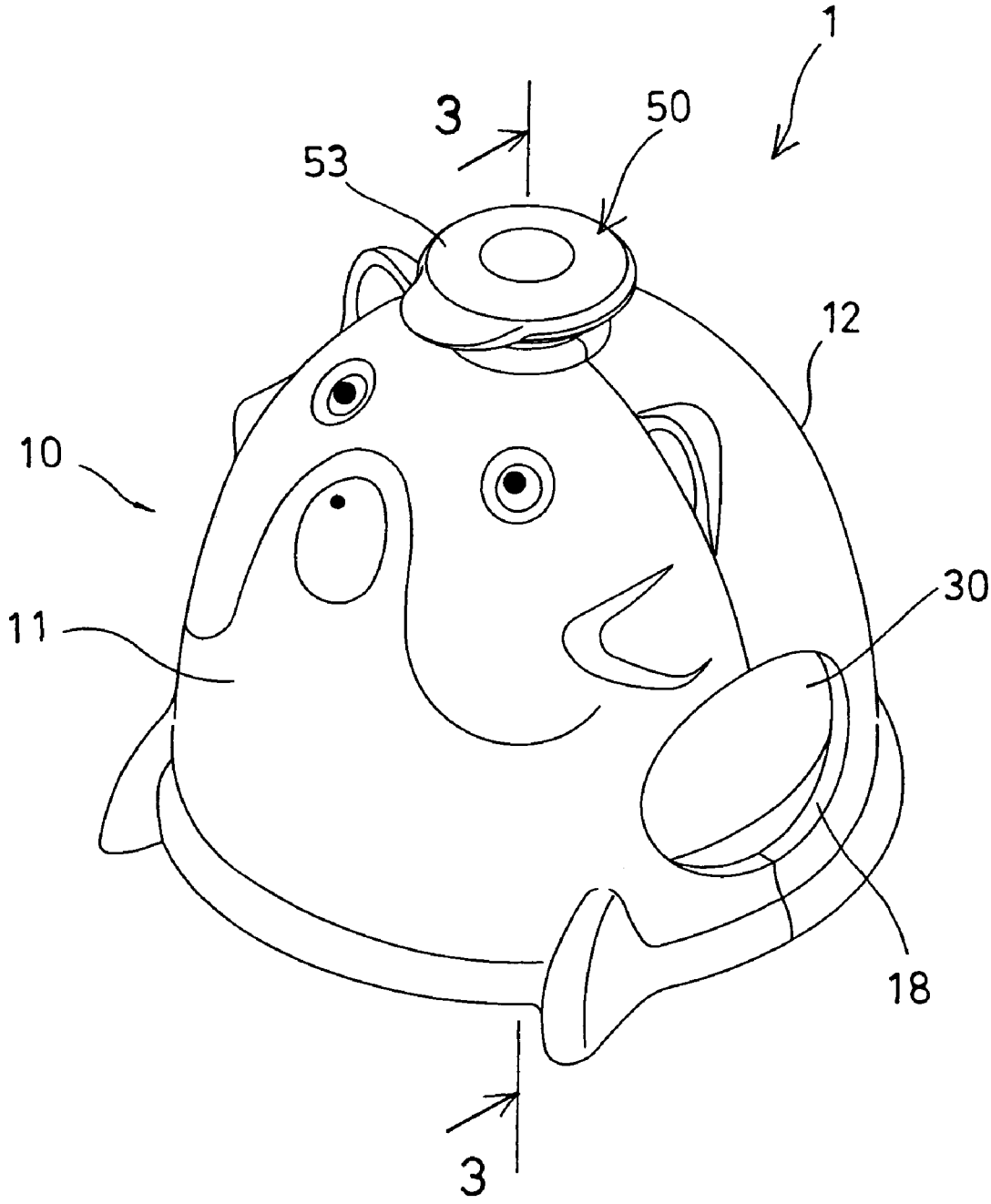
FIG. 2 is a perspective view of the bell device.
Figure 3:
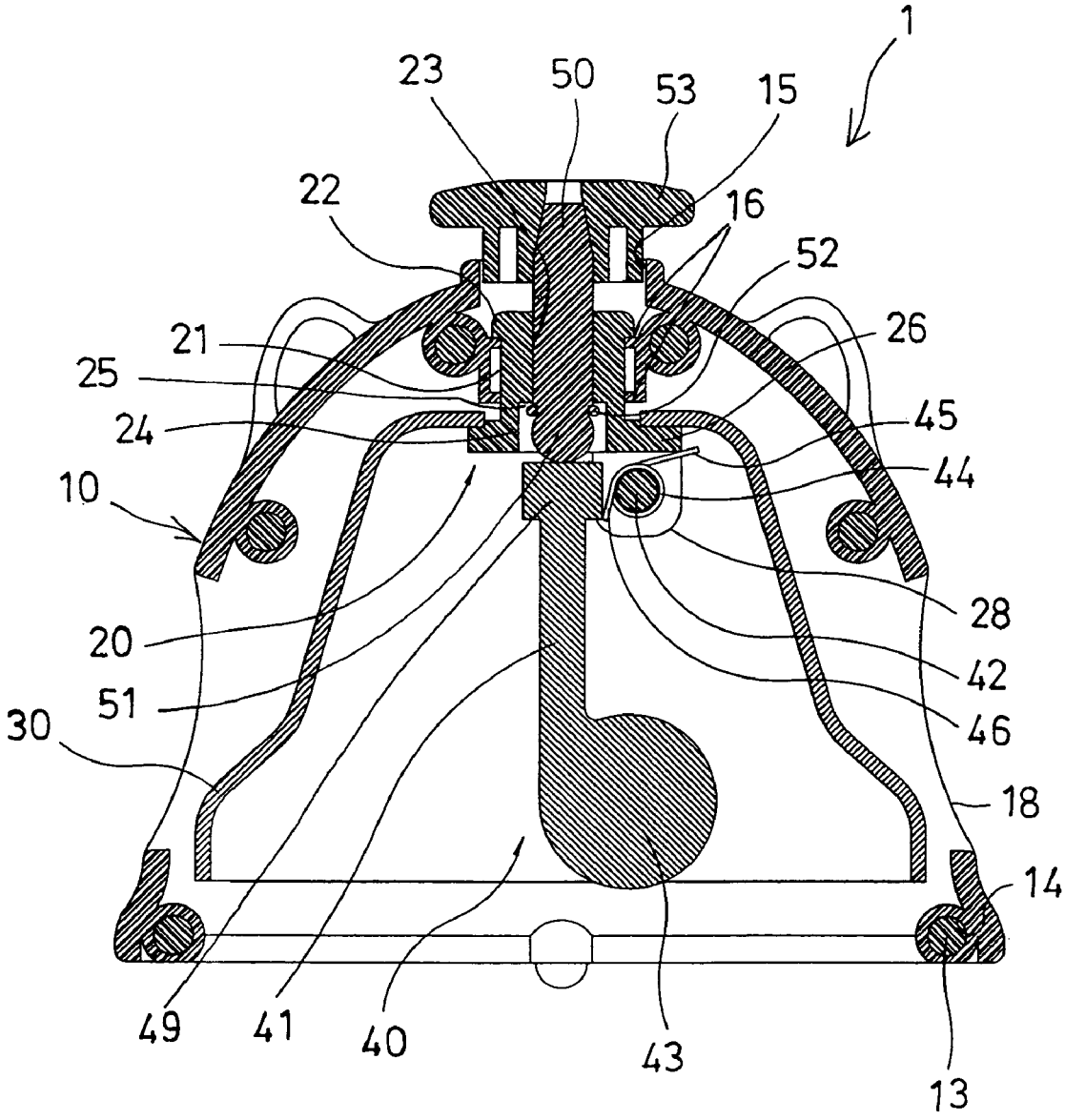
FIG. 3 is a cross sectional view of the bell device, taken along lines 3—3 of FIG. 2.

Referring to the drawings, and initially to FIGS. 1–3, a bell device 1 in accordance with the present invention comprises an outer housing 10 including one or more, such as two housing members 11, 12 secured together for forming various shapes, such as a bell-shaped structure or contour. For example, one of the housing members 11 may include one or more pegs 13 extended therefrom or extended toward the other housing member 12, and the other housing member 12 may include one or more cavities 14 formed therein for receiving the pegs 13 and for securing or coupling the housing members 11, 12 together with such as force-fitted engagements, or the like.

The outer housing 10 may be made of various materials, such as plastic materials, rubber materials, metal materials, or various synthetic materials, and may be formed into various decorative shapes or configurations, and includes an opening 15 formed in the upper portion thereof, and includes one or more, such as two peripheral ribs 16 extended into the opening 15 of the outer housing 10, and includes one or more orifices 18 formed in the outer housing 10 for such as sound resonant purposes. The housing members 11, 12 may each include one half of the peripheral ribs 16 and the opening 15 formed therein, for allowing the peripheral ribs 16 and the opening 15 to be formed in the outer housing 10 after the two housing members 11, 12 are assembled and secured together.

A coupler or securing device 20 includes a shank 21 disposed in or engaged through the opening 15 of the outer housing 10, and includes an enlarged peripheral flange 22 extended radially and outwardly from the upper portion of the shank 21 for engaging with either of the peripheral ribs 16 of the outer housing 10, and for allowing the shank 21 to be solidly anchored or secured to the outer housing 10, when assembling the two housing members 11, 12 together. The peripheral flange 22 of the shank 21 of the securing device 20 may be solidly engage with the peripheral rib 16 of the outer housing 10 and will not be disengaged from the peripheral ribs 16 of the outer housing 10 even when the shank 21 is depressed or pushed downwardly relative to the outer housing 10.

The securing device 20 includes a bore 23 formed therein, such as formed through the shank 21, and includes an enlarged compartment 24 formed in the inner or lower portion of the shank 21, and the compartment 24 includes an inner diameter greater than that of the bore 23 of the shank 21 for forming an inner peripheral shoulder 25 in the shank 21. The securing device 20 further includes an enlarged peripheral flap 26 extended radially and outwardly from the lower portion of the shank 21, and includes a non-circular bulge 27 also extended radially and outwardly from the shank 21 and located above the enlarged peripheral flap 26 or located between the enlarged peripheral flap 26 and the shank 21.

The securing device 20 further includes one or more, such as two ears 28 extended downwardly from the flap 26, and the ears 28 each includes an aperture 29 formed therein. The apertures 29 of the ears 28 are aligned with each other and are offset from the bore 23 of the shank 21 and preferably arranged perpendicular to the bore 23 of the shank 21. A metallic bell member 30 is disposed in the inner portion of the outer housing 10 and includes a non-circular orifice 31 formed in the upper portion thereof for receiving or engaging with the corresponding non-circular bulge 27 or the shank 21 of the securing device 20 such that the metallic bell member 30 may be suspended or supported in the outer housing 10 with the securing device 20. The engagement of the non-circular bulge 27 or the shank 21 of the securing device 20 with the corresponding non-circular orifice 31 of the metallic bell member 30 may anchor the metallic bell member 30 to the securing device 20 and may prevent the metallic bell member 30 from rotating relative to the securing device 20.

A clapper 40 includes a stem 41, and a shaft 42 attached to or extended from the upper portion 49 of the stem 41 and offset from the stem 41 and preferably arranged perpendicular to the stem 41 and rotatably or pivotally engaged into the apertures 29 of the ears 28 of the securing device 20 for rotatably or pivotally attaching or coupling the clapper 40 to the securing device 20. The clapper 40 includes an enlarged striking member 43 extended from the lower portion of the stem 41 for being actuated or swung to engage with or to strike onto the metallic bell member 30. A spring biasing means or member 44 is engaged onto the shaft 42 and includes one end 45 engaged with the flap 26 of the securing device 20 or the metallic bell member 30, and the other end 46 engaged with the stem 41 of the clapper 40 for biasing or forcing the enlarged striking member 43 of the clapper 40 away from the metallic bell member 30.

An actuator or push rod 50 is slidably disposed or engaged in the bore 23 of the shank 21 and includes a lower end 51 for contacting or engaging with the upper portion 49 of the stem 41, and for forcing or actuating the clapper 40 to pivot or rotate relative to the metallic bell member 30 around or about the shaft 42. A clamping ring 52 may be attached onto the lower portion of the push rod 50 and for engaging with the inner peripheral shoulder 25 of the shank 21 and for limiting the push rod 50 to move or to slide relative to the shank 21 and for preventing the push rod 50 from being disengaged from the shank 21. A knob 53 is attached or secured onto the upper portion of the push rod 50 for moving the push rod 50 to actuate or to rotate the clapper 40 relative to the metallic bell member 30 and thus for forcing or actuating the enlarged striking member 43 of the clapper 40 to engage with or to strike onto the metallic bell member 30.

Figure 4:
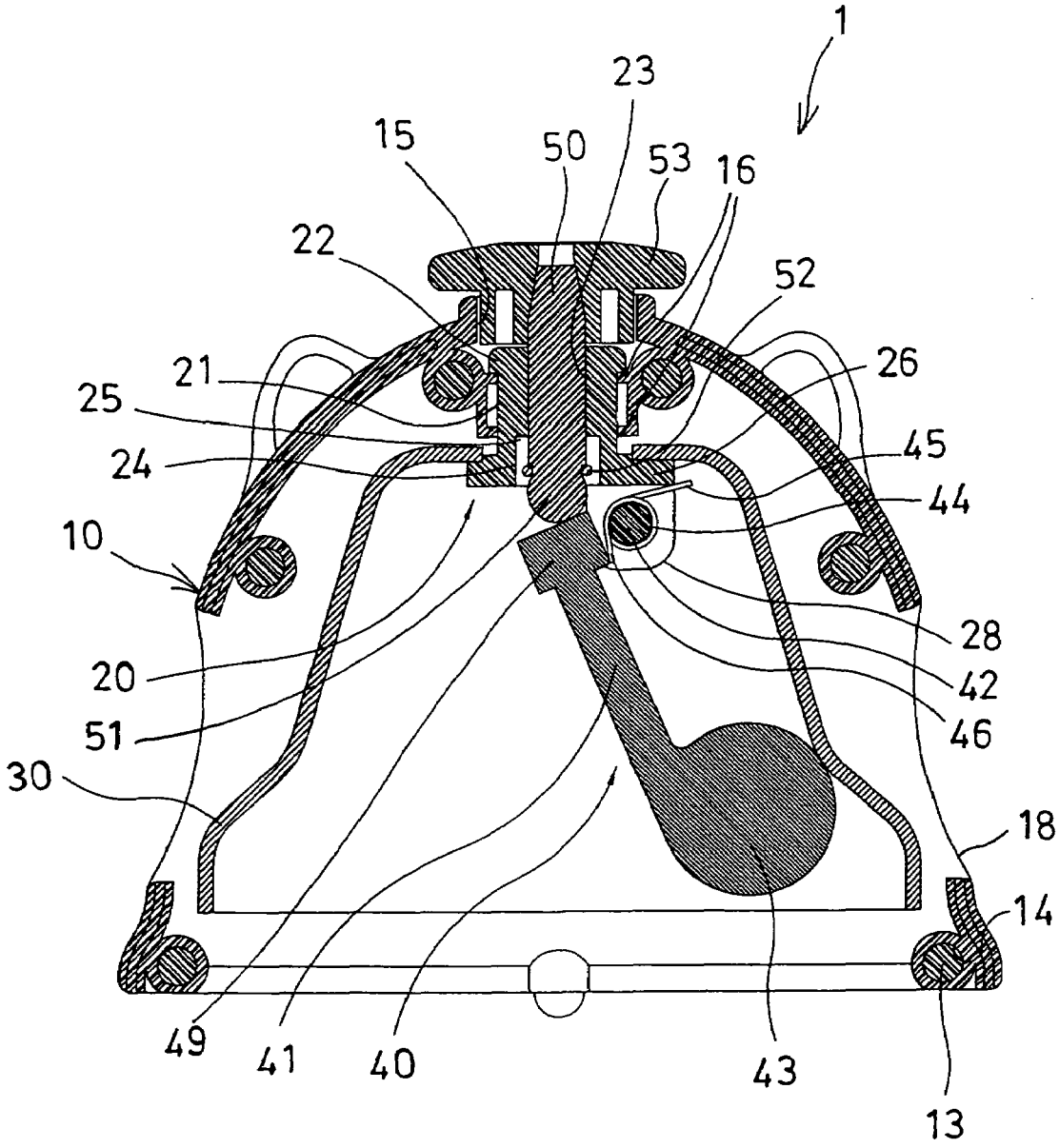
FIG. 4 is a cross sectional view similar to FIG. 3, illustrating the operation of the bell device.

In operation, as shown in FIGS. 3 and 4, the push rod 50 may be moved or depressed or actuated to engage with and to actuate or to rotate the clapper 40 relative to the metallic bell member 30 and thus to force or to actuate the enlarged striking member 43 of the clapper 40 to engage with or to strike onto the metallic bell member 30 in order to generate sounds. After the push rod 50 is released, the spring member 44 may bias or force the enlarged striking member 43 of the clapper 40 away from the metallic bell member 30 and ready for next striking operation.

It is to be noted that the peripheral flange 22 of the shank 21 of the securing device 20 may be solidly engage with the peripheral rib 16 of the outer housing 10 by assembling or securing the two housing members 11, 12 together, and the peripheral flange 22 of the shank 21 will not be disengaged from the peripheral ribs 16 of the outer housing 10 even when the shank 21 and the push rod 50 are depressed or pushed downwardly relative to the outer housing 10, such that the metallic bell member 30 may be solidly engaged with or secured or attached to the outer housing 10 with the securing device 20.

Accordingly, the bell device in accordance with the present invention includes a solid assembling or securing structure for solidly attaching or coupling the clapper into the bell device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A bell device comprising:

a housing including two housing members secured together, and including an opening formed therein, and including at least one peripheral rib extended into said opening of said housing, said housing members each including one half of said at least one peripheral rib and one half of said opening formed therein, for forming said peripheral rib and said opening in said housing after said two housing members are assembled together, a securing device including a shank engaged in said opening of said housing, and including a peripheral flange extended from an upper portion of said shank for engaging with said at least one peripheral rib of said housing and for anchoring said shank to said housing when assembling said two housing members together, said securing device including a bore formed therein, and including a peripheral flap extended from a lower portion of said shank, a bell member disposed in said housing and including an upper orifice formed therein for receiving said shank of said securing device, and said peripheral flap of said securing device being engaged with said bell member for supported said bell member in said housing with said securing device, a clapper including a stem having an upper shaft pivotally attached to said peripheral flap of said securing device for pivotally attaching said clapper to said securing device, and including a lower striking member for striking onto said bell member, means for biasing said striking member of said clapper away from said bell member, and a push rod slidably engaged in said bore of said shank and including a lower end for contacting and engaging with said upper portion of said shank, and for forcing said clapper to rotate relative to said bell member, and a knob attached to said push rod for moving said push rod to actuate and to rotate said clapper relative to said bell member, and for actuating said striking member of said clapper to strike onto said bell member, wherein a clamping ring is attached onto said push rod for engaging with said shank and for limiting said push rod to move relative to said shank, and said push rod being depressible to engage with and to rotate said clapper relative to said bell member and to actuate said striking member of said clapper to strike onto said bell member and to generate sounds, and said biasing means biasing and forcing said striking member of said clapper away from said bell member after said push rod is released.

2. The bell device as claimed in claim 1, wherein a first housing member of said housing members includes a plurality of cavities formed therein, and a second housing member of said housing members includes a plurality of pegs extended therefrom and engaged into said cavities of said first housing member for securing said housing members together.

3. The bell device as claimed in claim 1, wherein said housing includes at least one orifice formed therein for sound resonant purposes.

4. The bell device as claimed in claim 1, wherein said shank includes an enlarged compartment formed in said lower portion of said shank, and said compartment of said shank includes an inner diameter greater than that of said bore of said shank for forming an inner peripheral shoulder in said shank and for engaging with said clamping ring.

5. The bell device as claimed in claim 1, wherein said securing device includes a non-circular bulge extended radially and outwardly from said shank, and said orifice of said bell member is non-circular for receiving said non-circular bulge of said securing device and for anchoring said bell member to said securing device and for preventing said bell member from rotating relative to said securing device.

6. The bell device as claimed in claim 1, wherein said securing device includes two ears extended from said peripheral flap, and said ears each includes an aperture formed therein for rotatably receiving said shaft of said stem of said clapper.

* * * * *